US010008073B2

(12) United States Patent
Marks

(10) Patent No.: US 10,008,073 B2
(45) Date of Patent: Jun. 26, 2018

(54) METHOD OF GAMING, GAMING SYSTEM, AND GAME CONTROLLER THAT REMOVE SYMBOLS OF A WINNING COMBINATION AND DETERMINE WHETHER REMAINING SYMBOLS FORM ANOTHER WINNING COMBINATION

(71) Applicant: ARISTOCRAT TECHNOLOGIES AUSTRALIA PTY LIMITED, North Ryde, NSW (AU)

(72) Inventor: Daniel Marks, Decauter, GA (US)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 59 days.

(21) Appl. No.: 14/901,834

(22) PCT Filed: Aug. 7, 2015

(86) PCT No.: PCT/IB2015/001853
§ 371 (c)(1),
(2) Date: Dec. 29, 2015

(87) PCT Pub. No.: WO2016/024167
PCT Pub. Date: Feb. 18, 2016

(65) Prior Publication Data

US 2016/0210821 A1 Jul. 21, 2016

(30) Foreign Application Priority Data

Jul. 30, 2014 (AU) ..... 2014902942

(51) Int. Cl.
*G07F 17/34* (2006.01)
*G07F 17/32* (2006.01)

(52) U.S. Cl.
CPC ..... *G07F 17/3267* (2013.01); *G07F 17/326* (2013.01); *G07F 17/34* (2013.01)

(58) Field of Classification Search
CPC ..... G07F 17/326; G07F 17/3267
See application file for complete search history.

(56) References Cited

U.S. PATENT DOCUMENTS 6,910,962 B2 * 6/2005 Marks ..... G07F 17/32 463/16
7,144,322 B2 * 12/2006 Gomez ..... G07F 17/32 463/16

(Continued)

OTHER PUBLICATIONS

Notification Concerning Transmittal of International Preliminary Report on Patentability dated Feb. 9, 2017 with International Preliminary Report on Patentability corresponding to International Patent Application No. PCT/IB2015/001853.

(Continued)

*Primary Examiner* — David Duffy
(74) *Attorney, Agent, or Firm* — McAndrews, Held & Malloy, Ltd.

(57) ABSTRACT

An electronic method of gaming comprises an electronic game controller forming a first game outcome by selecting a plurality of symbols for display at respective ones of a plurality of symbol display positions of a symbol display, evaluating the first game outcome to determine whether the symbol display includes a designated winning symbol combination, upon the displayed symbols including a designated winning symbol combination, a) making an award in respect of the designated winning symbol combination and b) removing symbols of the designated winning symbol combination and at least one further, non-winning symbol from the symbol display, forming a second game outcome at least from remaining symbols of the first game outcome, and evaluating the second game outcome to determine whether to make an award.

23 Claims, 6 Drawing Sheets

(56) References Cited

U.S. PATENT DOCUMENTS 7,252,591 B2 * 8/2007 Van Asdale ..... G07F 17/3262 463/20
7,749,082 B2 * 7/2010 Dunaevsky ..... G07F 17/3211 463/1
7,887,407 B1 * 2/2011 Singer ..... G07F 17/32 463/10
8,105,151 B2 * 1/2012 Caputo ..... G07F 17/3265 463/21
8,113,941 B2 * 2/2012 Gomez ..... G07F 17/32 463/16
8,152,623 B2 4/2012 Fiden
8,192,275 B2 * 6/2012 Aoki ..... G07F 17/34 463/16
9,202,339 B2 * 12/2015 Ching ..... G07F 17/3267
2002/0094857 A1 * 7/2002 Meyer ..... G07F 17/3265 463/16
2004/0023714 A1 * 2/2004 Asdale ..... G07F 17/3262 463/22
2004/0033829 A1 * 2/2004 Pacey ..... G07F 17/3265 463/20
2012/0238348 A1 * 9/2012 Aoki ..... G07F 17/34 463/21
2013/0267299 A1 * 10/2013 Ching ..... G07F 17/3267 463/20
2015/0371489 A1 * 12/2015 Aoki ..... G07F 17/34 463/20

OTHER PUBLICATIONS

International Search Report and Written Opinion for International Patent Application No. PCT/IB2015/001853, dated Dec. 15, 2015.

* cited by examiner

METHOD OF GAMING, GAMING SYSTEM, AND GAME CONTROLLER THAT REMOVE SYMBOLS OF A WINNING COMBINATION AND DETERMINE WHETHER REMAINING SYMBOLS FORM ANOTHER WINNING COMBINATION

FIELD

The present invention relates to a method of gaming, a gaming system and a game controller.

BACKGROUND

In electronic gaming systems such as spinning reel or "slot" gaming machines, symbols are selected for display on a display of the machine. The displayed symbols are evaluated to determine whether an award is to be made to a player.

While such gaming systems provide players with enjoyment, a need exists for alternative gaming systems.

SUMMARY

In a first aspect, the invention provides an electronic method of gaming comprising an electronic game controller:

- forming a first game outcome by selecting a plurality of symbols for display at respective ones of a plurality of symbol display positions of a symbol display;
- evaluating the first game outcome to determine whether the symbol display includes a designated winning symbol combination;
- upon the displayed symbols including a designated winning symbol combination, a) making an award in respect of the designated winning symbol combination and b) removing symbols of the designated winning symbol combination and at least one further, non-winning symbol from the symbol display;
- forming a second game outcome at least from remaining symbols of the first game outcome; and
- evaluating the second game outcome to determine whether to make an award.

In an embodiment, the method comprises the game controller selecting one or more replacement symbols and forming the second game outcome from the remaining symbols and the one or more replacement symbols.

In an embodiment, the method comprises the game controller selecting replacement symbols for each of the removed symbols.

In an embodiment, forming the second game outcome comprises the game controller re-arranging the remaining symbols within the symbol display.

In an embodiment, the method comprises the game controller randomly selecting the at least one non-winning symbol for removal.

In an embodiment, the symbol display comprises a plurality of columns comprised of respective subsets of the plurality of symbol display positions, and removing the at least one non-winning symbol comprises the game controller removing all other symbols from each column having a symbol of the designated winning symbol combination.

In an embodiment, re-arranging the remaining symbol comprises the game controller moving the remaining symbols to the left-most column or columns of the symbol display.

In an embodiment, the symbol display comprises a plurality of rows comprised of respective subsets of the plurality of symbol display positions, and removing the at least one non-winning symbol comprises the game controller removing all other symbols from a row having a designated winning symbol combination.

In an embodiment, re-arranging the remaining symbol comprises the game controller moving the remaining symbols to the bottom-most row or rows of the symbol display.

In an embodiment, re-arranging the remaining symbols comprises the game controller moving the remaining symbols, where possible, in a defined direction relative to the symbol display to fill symbol display positions vacated by the removed symbols.

In an embodiment, there are a plurality of designated winning combinations.

In an embodiment, each designated symbol combination includes at least one substituting symbol.

In an embodiment, the method comprises the game controller adjusting a value of one or more awards based on the remaining symbols in response to removing symbols.

In an embodiment, the method comprises, upon the second game outcome including a designated winning symbol combination, the game controller removing the designated winning symbol combination and at least one further, non-winning symbol from the second game outcome and forming a third game outcome from the remaining symbols.

In an embodiment, the game controller removes the at least one non-winning symbol from the first game outcome in accordance with a first rule and removes the at least one non-winning symbol from the second game outcome in accordance with a second, different rule.

In an embodiment, the game controller conducts a plurality of cycles of removing symbols and selecting replacement symbols.

In an embodiment, the game controller selects different numbers of replacement symbols in at least two of the cycles.

In an embodiment, each cycle results in the game controller results in one fewer symbol in the respective game outcome.

In an embodiment, a limit is placed on the number of cycles.

In an embodiment, the cycles continue until there is no designated winning symbol combination.

In a second aspect, the invention provides an electronic game controller for a gaming system, the game controller arranged to:

- form a first game outcome by selecting a plurality of symbols for display at respective ones of a plurality of symbol display positions of a symbol display;
- evaluate the first game outcome to determine whether the symbol display includes a designated winning symbol combination;
- upon the displayed symbols including a designated winning symbol combination, a) make an award in respect of the designated winning symbol combination and b) remove symbols of the designated winning symbol combination and at least one further, non-winning symbol from the symbol display;
- form a second game outcome at least from remaining symbols of the first game outcome; and
- evaluate the second game outcome to determine whether to make an award.

In a third aspect, the invention provides a electronic gaming system comprising:

- a game outcome generator arranged to form a first game outcome by selecting a plurality of symbols for display at respective ones of a plurality of symbol display positions of a symbol display;

a game outcome evaluator arranged to evaluate the first game outcome to determine whether the symbol display includes a designated winning symbol combination, and upon the displayed symbols including a designated winning symbol combination, make an award in respect of the designated winning symbol combination; and a symbol remover arranged to remove symbols of the designated winning symbol combination and at least one further, non-winning symbol from the symbol display, whereafter the game outcome generator forms a second game outcome at least from remaining symbols of the first game outcome, and the game outcome evaluator evaluates the second game outcome to determine whether to make an award.

In an embodiment, the gaming system comprises a symbol replacer for selecting one or more replacement symbols, and wherein the outcome generator forms the second game outcome from the remaining symbols and the one or more replacement symbols.

In a fourth aspect, the invention provides a gaming system comprising:

means for forming a first game outcome by selecting a plurality of symbols for display at respective ones of a plurality of symbol display positions of a symbol display;

means for evaluating the first game outcome to determine whether the symbol display includes a designated winning symbol combination;

means for, upon the displayed symbols including a designated winning symbol combination, a) making an award in respect of the designated winning symbol combination and b) removing symbols of the designated winning symbol combination and at least one further, non-winning symbol from the symbol display;

means for forming a second game outcome at least from remaining symbols of the first game outcome; and means for evaluating the second game outcome to determine whether to make an award.

In a fifth aspect, the invention provides computer program code which when executed by a processor:

forms a first game outcome by selecting a plurality of symbols for display at respective ones of a plurality of symbol display positions of a symbol display;

evaluates the first game outcome to determine whether the symbol display includes a designated winning symbol combination;

upon the displayed symbols including a designated winning symbol combination, a) makes an award in respect of the designated winning symbol combination and b) removes symbols of the designated winning symbol combination and at least one further, non-winning symbol from the symbol display;

forms a second game outcome at least from remaining symbols of the first game outcome; and evaluates the second game outcome to determine whether to make an award.

In a sixth aspect, the invention provides a tangible computer readable medium comprising the above program code.

BRIEF DESCRIPTION OF DRAWINGS

An exemplary embodiment of the invention will now be described with reference to the accompanying drawings in which.

DETAILED DESCRIPTION

Figure 1:
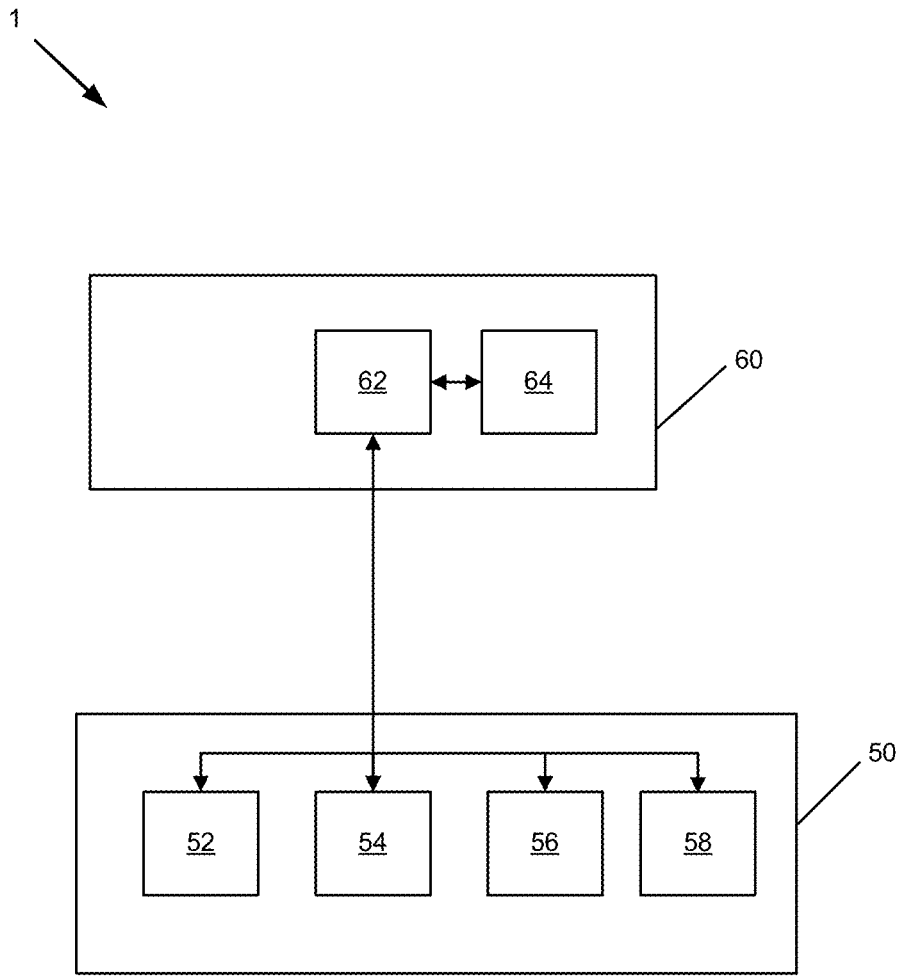
FIG. 1 is a block diagram of the core components of a gaming system.

Referring to the drawings, there is shown an embodiment of an electronic gaming system having an electronic game controller arranged to implement a game wherein a first game outcome is formed by selecting symbols for display at a plurality of symbol display positions. The first game outcome is evaluated by the game controller to determine if it includes a designated winning symbol combination. If it does, the symbols of the designated symbol combination and at least one further, non-winning symbol are removed by the electronic game controller from the symbol display. A second game outcome is formed by the electronic game controller from at least the remaining symbols. The second game outcome is evaluated by the game controller to determine whether to make an award. If an award condition is met, the game controller makes the award, e.g. by applying an award of credits to a win meter of the gaming system.

In some embodiments, one or more replacement symbols are selected by the game controller and are used in combination with the remaining symbols to form the second game outcome. In some embodiments, the remaining symbols are rearranged within the symbol display by the game controller when forming the second game outcome.

In some embodiments there may be a number of cycles of removing and replacing symbols to form game outcomes conducted by the game controller. In one embodiment, game outcomes are formed by the game controller until a game outcome does not include a designated winning symbol combination.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired.

Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
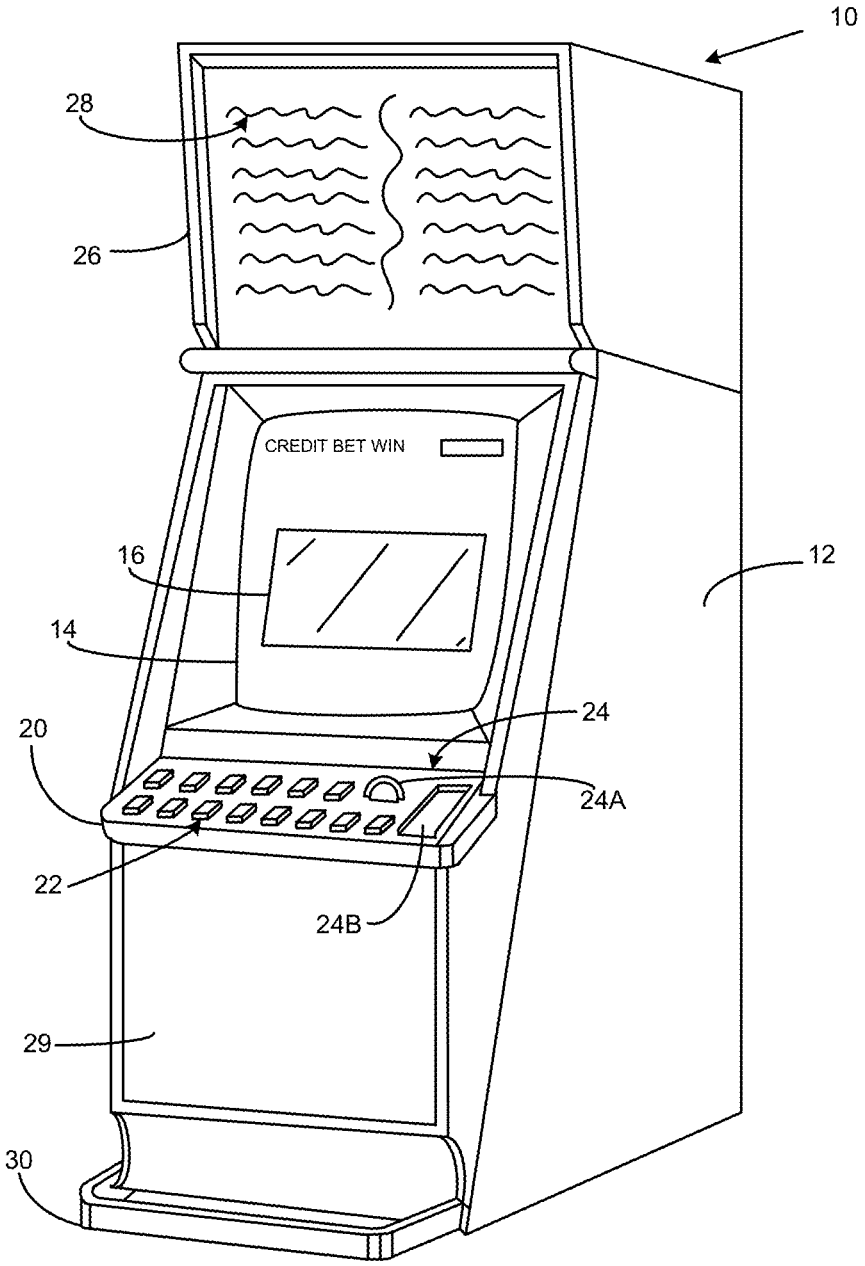
FIG. 2 is a perspective view of a standalone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
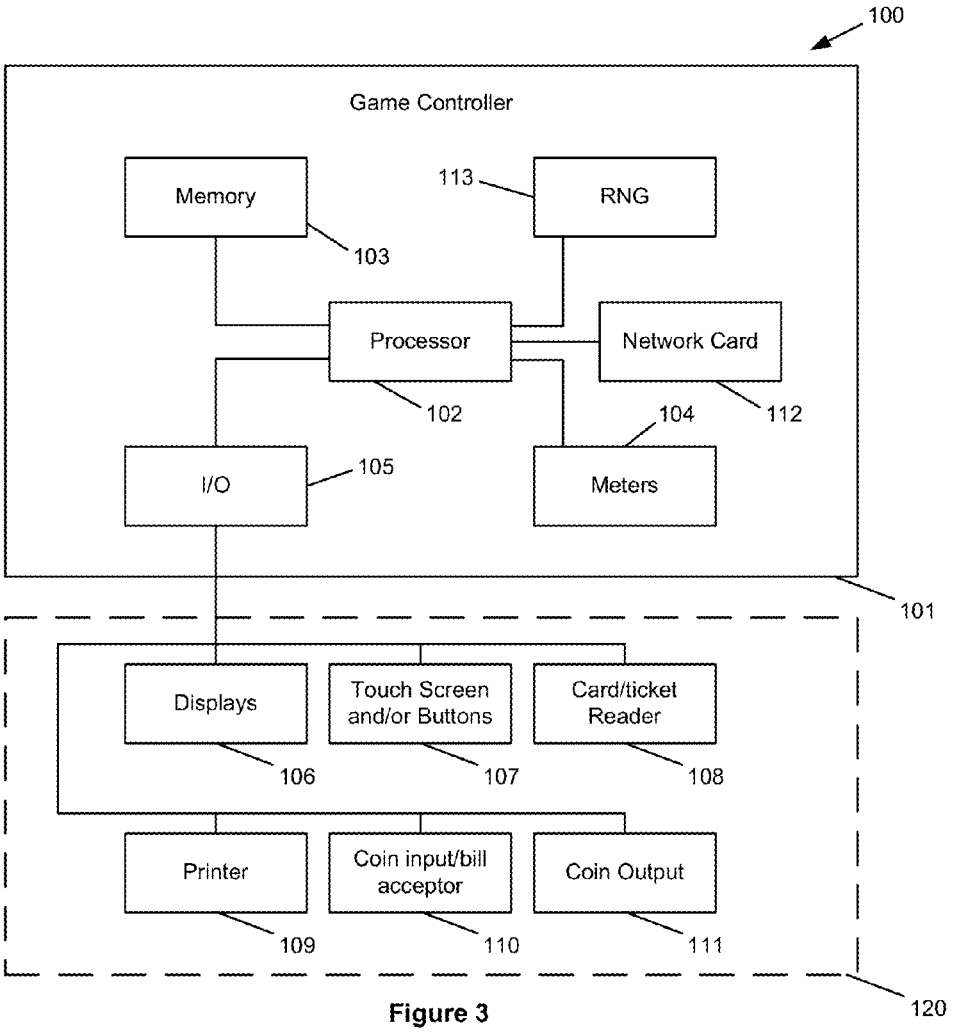
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
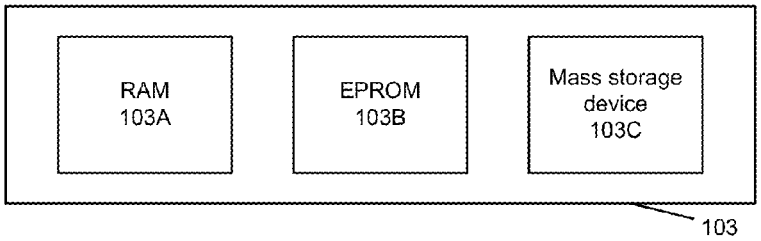
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
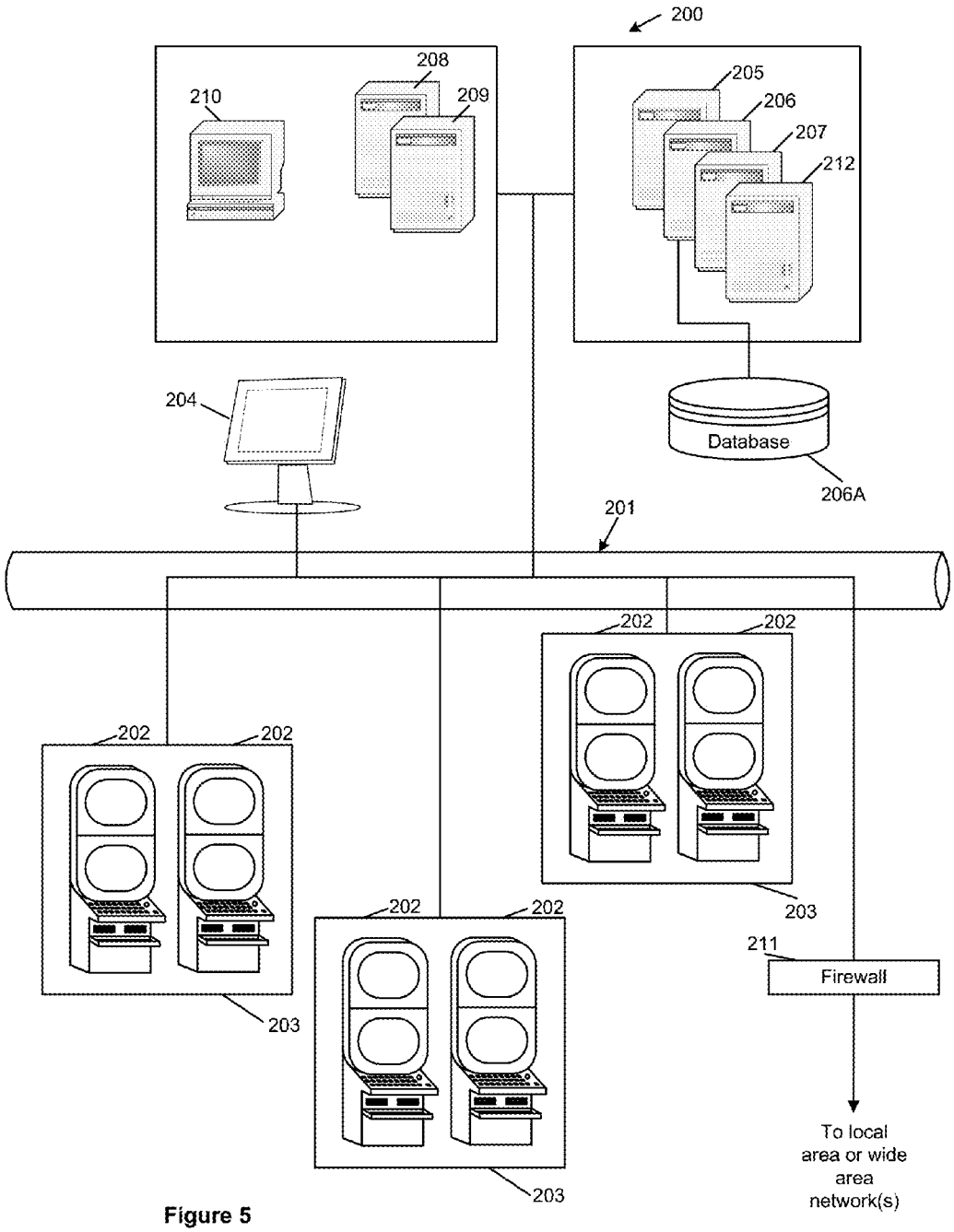
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art, will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

Figure 6:
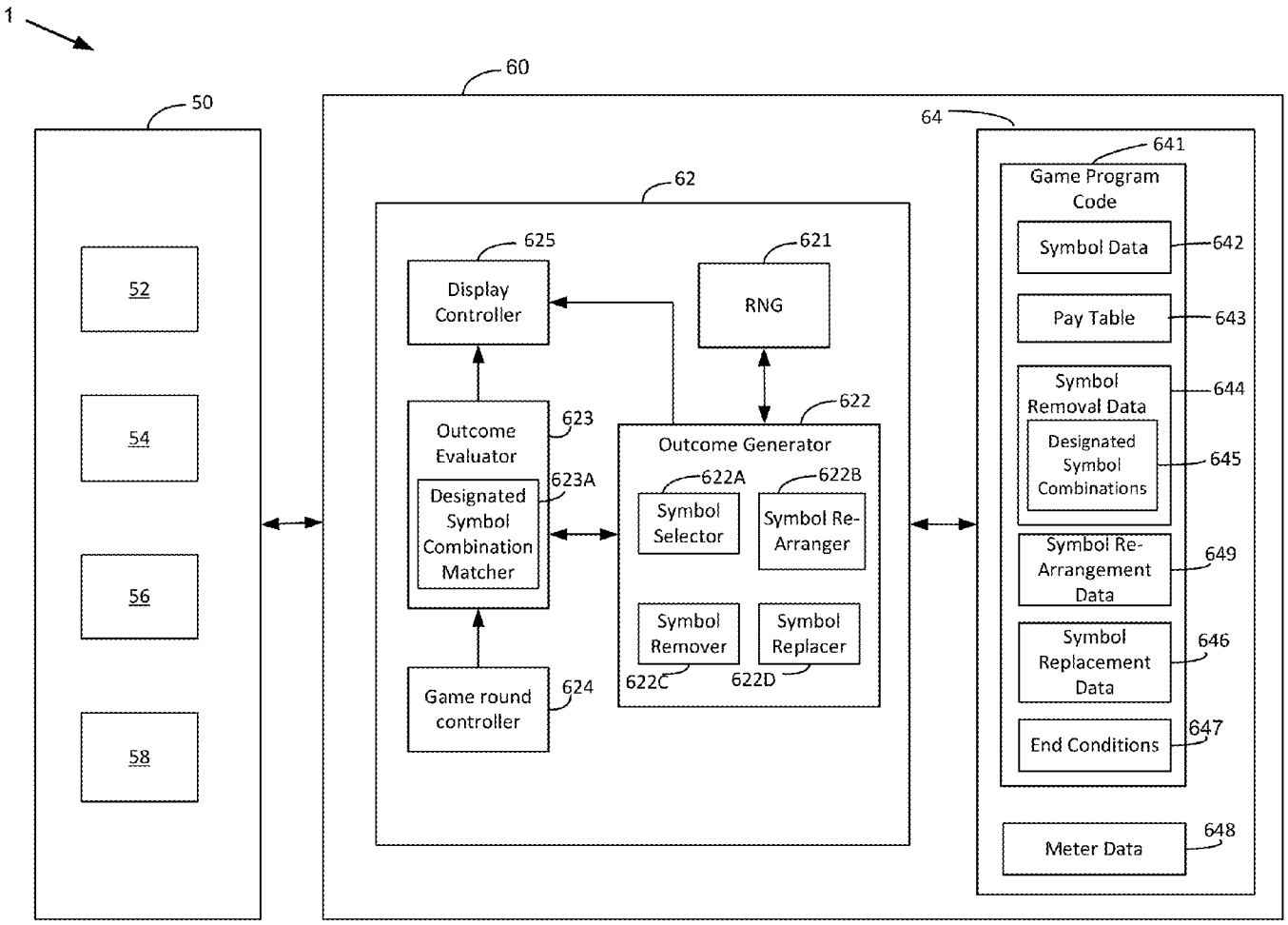
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by outcome evaluator 623. The first part of forming the game outcome is for a symbol selector 622A to select symbols from a set of symbols specified by symbol data 641 using random number generator 621. The selected symbols are communicated to the display controller 625 which causes them to be displayed as a symbol display on display 54 at a set of display positions.

In the embodiment described below, the display positions of the symbol display on the display 54 are arranged in a rectangular matrix comprising a plurality of columns and a plurality of rows. However, in other arrangements are known in the gaming industry and could be employed in embodiments of the invention. For example, in some arrangements there are more symbols in some columns than other, such as 3-4-3-4-3 arrangement of seventeen display positions corresponding to respective ones of five reels. In such arrangements, the columns of four symbols may be arranged on the display so that they are off-set or staggered relative to the columns having two symbols so that the middle two symbols in the columns of four symbols share boundaries with two symbols of each neighbouring reel.

In one embodiment, the outcome generator 622 of game controller 60 is arranged to generate one or more game outcomes. All outcomes are displayed on display 54 under control of display controller 625. One example of generating a first game outcome is for the symbol selector 622A to select symbols for display from symbol data 641 in the form of a plurality of symbol sets corresponding to respective ones of a plurality of reels. The symbol sets specify a sequence of symbols for each reel such that the symbol selector 622A can select all of the symbols to be displayed for each reel by selecting a stopping position in the sequence. In one example, three symbols of each of five reels may be displayed such that symbols are displayed at fifteen display positions on display 54. It is known to use a probability table stored in memory 64 to vary the odds of a particular stop position being selected. Other techniques can be used to control the odds of particular outcomes occurring to thereby control the return to player of the game.

Once the symbols are selected by the symbol selector 622A of outcome generator 622, they are evaluated by the outcome evaluator 623 to determine whether they include any of a set of winning combinations defined by pay table 643 to determine whether to make an award. Any award is added by the game controller 60 to the win meter maintained in memory 64 as part of meter data 648. The meter data 648 also includes the current value of a credit meter. The current values of the credit and win meters are displayed on display 54 by the display controller 625. Wins are transferred by the game controller from the win meter to the credit meter at the end of a play of the game. Wagers are deducted from the credit meter by the game controller when play of a game commences.

In the embodiment, all game outcomes are also evaluated by the game controller to determine whether they include a designated symbol combination. To this end, outcome evaluator 623 includes a designated symbol combination matcher 623A which compares the selected symbols displayed on display 54 to designated winning symbol combinations 645 stored in the memory 64. Depending on the embodiment, the designated winning symbol combinations may be, for example, all winning combinations in the pay table, a subset of the winning combinations in the pay table, or only those winning combinations which are completed using a substitute symbol, commonly known as a WILD symbol.

If the designated symbol combination matcher 623A determines that there is a designated winning symbol combination 645, it causes symbol remover 622C to carry out a symbol removal operation as at least part of the formation of a second game outcome. The symbol remover 622C carries out the symbol removal operation in accordance with the rules specified by symbol removal data 644. In embodiments of the invention, each symbol removal operation carried out in respect of a designated winning symbol combination 645 by the symbol remover 622C involves removal of the designated winning symbol combination and at least one other, non-winning symbol. In one embodiment, described in further detail below, removing the symbols by the symbol remover 622C comprises removing the designated winning symbol combination and all other non-winning symbols in the same columns of the symbol display as symbols of the designated winning symbol combination.

In an embodiment of the invention, removed symbols are replaced with replacement symbols by symbol replacer 622D to form a second game outcome. In this respect, FIG. 6 shows the symbol replacer 622D as separate to the symbol selector 622A to indicate that the process of replacing symbols need not be the same as the process for selecting symbols. However, in the some embodiments, especially those where the symbol replacement process is the same as the symbol selection process, there need not be a symbol replacer 622D but instead the outcome generator 622 could cause the symbol selector 622A to replace symbols such that the symbol selector 622A also acts as the symbol replacer.

In one embodiment, in addition to the symbols of the winning symbol combination, symbol removal data 644 defines that all non-winning symbols from the same reel (or column) in the symbol display on display 54 are removed. In this embodiment, the removed symbols are replaced by the symbol replacer 622D by randomly selecting symbols from the virtual reels corresponding to the columns that are no longer populated using the symbol selection technique described above.

In some embodiments, before the removed symbols are replaced by the symbol replacer 622D, the remaining symbols are re-arranged by the symbol re-arranger 622B in accordance with one or more symbol re-arrangement rules 649 stored in memory 644. In one example where winning combinations are evaluated from left to right, the symbols in the symbol display are moved by the symbol re-arranger 622B to occupy the left most positions of the symbol display. In this embodiment, the reels used by symbol replacer 622D to select new symbols are those corresponding to the empty columns of the symbol display after the re-arrangement of symbols. In other embodiments, the symbols may not be re-arranged. In other embodiments, different reels to the original reels or a different symbol selection technique altogether can be employed by the symbol replacer 622D to select the replacement symbols.

In embodiments of the invention, the outcome evaluator 623 evaluates the second outcome to determine whether to make an award. In some embodiments, this evaluation is also based on pay table 643. In other embodiments, for example, those involving a reduced number of symbols in the second game outcome, a different pay table may be used to determine whether to make a further award in respect of the second game outcome.

In some embodiments, the designated symbol combination matcher 623A also determines whether the symbols of the second outcome correspond to any of the designated winning symbol combinations 645. In such embodiments, it is possible for there to be a number of cycles of removal and replacement of symbols carried out by the game controller such that there may be a number of game rounds. To this end, in one embodiment a game round controller 624 controls the cycles of removal and replacement based on one or more end conditions 647. While the end condition is not satisfied, the game round controller 624 allows the cycles of removal and replacement to continue, and hence controls whether there will be another cycle. In one example, there may be a limit in the form of a designated number of replacement and/or removal cycles. In one such embodiment, the game round controller 624 maintains a counter of the number of times where symbol removal has resulted. When the limit is reached, the game round controller causes the outcome evaluator 623 to operate so as to only make an award based on pay table 643 and not to also carry out the designated winning symbol combination matching process. As a result, no further symbols will be removed and the game will end.

It will be appreciated that in some embodiments, the removal and replacement of symbols may only occur during part of the game, such as during a feature game conducted by the game controller in response to a trigger condition being met. In other embodiments, the symbol removal and replacement may be carried out by the game controller in both the base and the feature games. Outcomes may be generated in the feature game by the game controller in the same manner as in a base game or differently.

Figure 7:
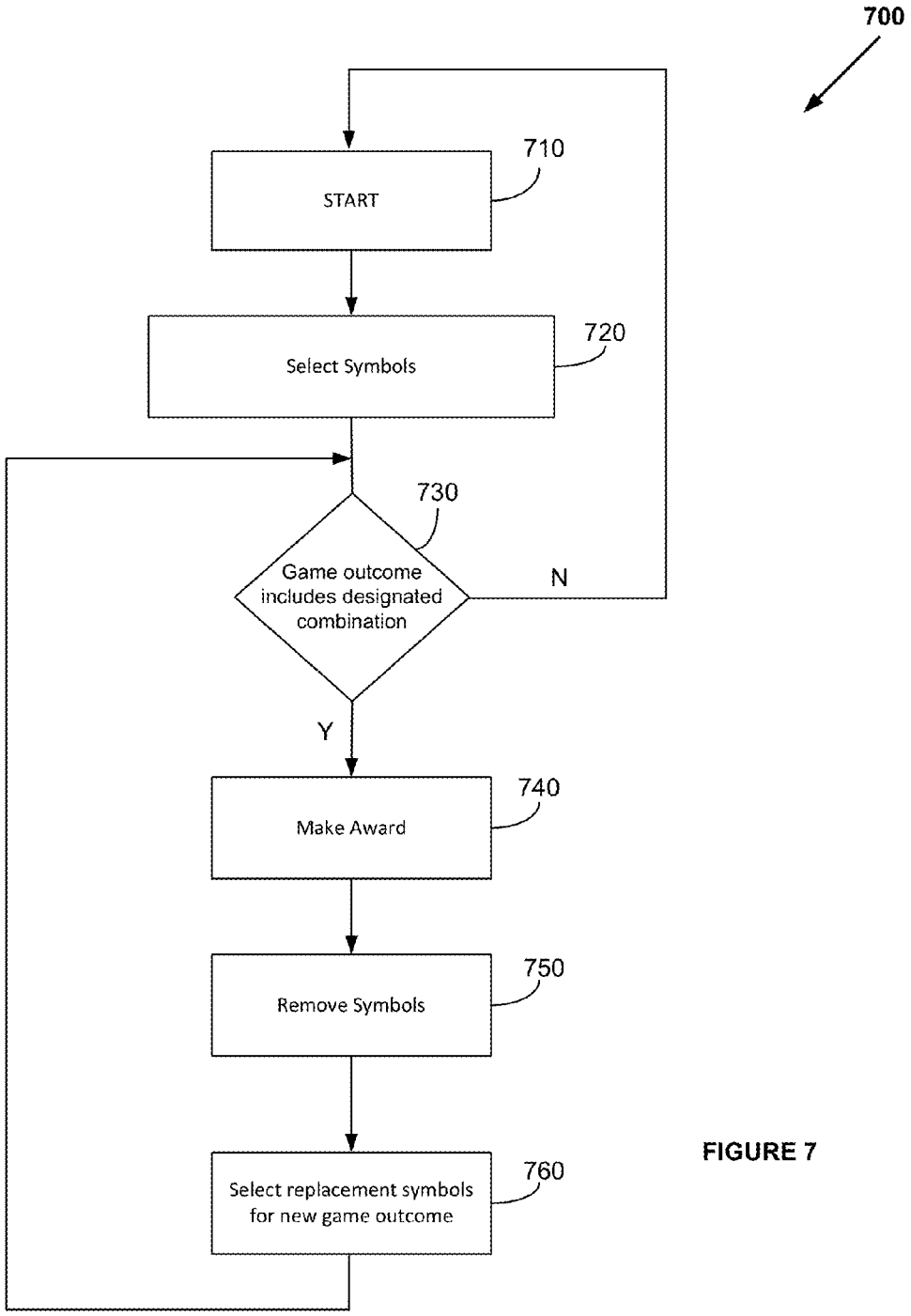
FIG. 7 is a flow chart of an embodiment.

Referring to FIG. 7, there is shown a method 700 of an embodiment of the invention. In the method 700, after game play starts 710, the method involves the game controller selecting symbols 720. It is then determined by the game controller whether a game outcome includes a designated winning combination 730. Accordingly, if there is no designated winning combination, the game ends and the player may initiate a new play of the game. If there is a winning combination, an award is made 740 by the game controller, symbols are removed 750 by the game controller and replacement symbols are selected by the game controller for the next game outcome 760. It is then determined again by the game controller whether the game outcome includes designated winning symbol combination 730. Accordingly, in the example of FIG. 7 game play will continue under the control of the game controller until there is no designated winning symbol combination.

It will be understood to persons skilled in the art of the invention that many modifications may be made without departing from the spirit and scope of the invention, in particular it will be apparent that certain features of embodiments of the invention can be employed to form further embodiments. For example, depending on the embodiment, any number of non-winning symbols may be removed from the symbol display. For example, for each winning symbol a randomly selected non-winning symbol may be removed.

Depending on the embodiment, the symbol removal data 644 may specify different rules for the location or nature of the additional non-winning symbols removed from the symbol display. For example, all non-winning symbols on the same row or payline as a winning symbol of the designated symbol combination 645 may be removed.

Either all or a sub-set of the winning symbol combinations in the pay table 643 may trigger the removal of the winning symbols by the game controller or may trigger the removal non-winning symbols. In one example, only winning symbols including a wild symbol trigger the removal of symbols by the game controller. In another example, all winning combinations trigger the removal of the symbols of the winning combination but only certain winning combinations are designated winning symbol combinations 645 which also trigger the removal of non-winning symbols. For example, if the removal rule is to remove all winning symbols from a payline, and there are five reels, then five-of-a-kind winning symbol combinations may be removed without also triggering removal of a non-winning symbol by the game controller, while other winning symbol combinations of less than five symbols also trigger removal of a non-winning symbol.

There may also be other effects of removed symbols upon the position remaining symbols in the symbol display which may or may not result in the symbols being rearranged by symbol re-arranger 622B. For example, remaining symbols may stay in position or the symbol re-arranger 622B may adjust their location by sliding them "downwards" towards the bottom of the symbol display, if possible, to fill position vacated by removed symbols.

In some embodiments, the remaining symbols as re-arranged by the symbol re-arranger 622B may form the second game outcome and be evaluated by outcome evaluator 623—i.e. the removed symbols are not replaced. For example, in an embodiment where the symbols on a payline are removed together with any non-winning symbols on the same payline, and where the symbols are re-arranged by moving them downwards where possible, the process of re-arrangement will result in two rows of symbols which can be re-evaluated.

In some embodiments, the removal of symbols may affect the value of remaining symbols in the symbol display. For example, the value of remaining symbols may be enhanced and produce increased awards for winning combinations in a subsequent outcome evaluated by the game controller.

In some embodiments, the gaming system may be configured so that rules for replacing symbols in the symbol display may vary. For example, all non-winning symbols in the same column are removed in a first removal by the game controller and then all non-winning symbols in the same row are removed in a subsequent removal by the game controller. In another example, the number of symbols removed or their location before removal may affect the manner in which they are replaced.

Any suitable method may be used by the game controller to display replacement of removed symbols. For example, replacement symbols may appear in the symbol display by appearing, spinning, dropping from top, rising from bottom, or sliding in from side of symbol display.

Depending on the embodiment, different methods of determining replacement symbols may be used by the game controller. For example, replacement symbols may be symbols: from the same reel strips used in the initial spin (e.g. to generate a first game outcome); from different reels strips used in the initial spin; from weighted tables; from random generation from a set of symbols; from one or more predetermined symbol scripts such that the game controller selects that replacement symbol based on a defined order of replacement symbols. In some embodiments, the method of selecting replacement symbols is related to the method of removing symbols and/or re-arranging symbols. For example, in embodiments where symbols of an entire reel are removed, it may be convenient to use a reel strip to replace the symbols.

Depending on the embodiment, there may be different numbers of replacement cycles from 1 to N and hence different numbers of game rounds within a single play of the game. In one example, replacement cycles may be capped at ten in the base game and at twenty in a bonus free spin feature game. Further, replacement cycles may continue in accordance with wager level, player input, and/or until no winning symbol combination appears in the symbol display.

In some embodiments, an eligibility criteria may be applied by the gaming system for the player to access the symbol removal and replacement feature, for example, the gaming system may be configured to determine that the player has made a certain sized wager, made an ante bet, selected all win lines, played sufficient games, or the player is a member of a loyalty program.

Depending on the embodiment, symbol removal may be carried out by the game controller in either one or both of the base game and a feature game. The base game is a part of the game which is carried out each time the player makes a wager, typically irrespective of the wager, whereas typically the feature game the game will only be carried out occasionally for example if a condition is met such as a trigger.

The trigger event for a feature game may be, a symbol combination in the game, occurrence of a specific symbol in the game, purchased, be caused by another connected system, based on turnover, based on a random evaluation, etc.

EXAMPLE

In one example, a gaming or "slot" machine has a symbol display comprised of 3 rows by 5 columns defining 15 symbol positions arranged in a rectangular matrix, with one symbol displayed in each symbol position. The gaming machine is configured to evaluate a sub-set of outcomes as "winning" and provide an award for each such winning outcome in accordance with an award schedule specified by a pay table 643.

For example, a winning symbol outcome ("X-X-X") appears in the 3-row by 5-column symbol display shown below and generates a 10-credit award based upon the pay schedule for X-X-X symbol combinations.

| | | | | |
|---|---|---|---|---|
| X | X | X | A | A |
| C | D | A | F | A |
| B | E | F | G | C |

Following the issuance of awards for any such winning outcome, the gaming machine removes all of the symbols comprising the winning outcome (X-X-X) along with any other symbols appearing in the columns in which the winning outcome appears.

For example, following the 10-credit award, the X-X-X symbols along with the A, B, C, D, E, and F symbols displayed in the columns in which the X-X-X symbols appear are removed from the symbol display, as indicated below by "-" indicia.

| | | | | |
|---|---|---|---|---|
| — | — | — | A | A |
| — | — | — | F | A |
| — | — | — | G | C |

The gaming machine then re-arranges the remaining symbols by shifting all remaining symbols to the leftmost available symbol positions in the symbol display. For example, the remaining A, B, C, F and G symbols in the symbol matrix shift leftwards as shown below.

| | | | | |
|---|---|---|---|---|
| A | A | — | — | — |
| F | A | — | — | — |
| G | C | — | — | — |

And the gaming machine replaces all of the symbols removed from the symbol display with new symbols introduced from the right most positions of each row. For example, new A, C, and D symbols are introduced on row 1, B and F symbols on row 2, and A, E, and G symbols on row 3, as shown below.

| | | | | |
|---|---|---|---|---|
| A | A | A | C | D |
| F | A | F | B | F |
| G | C | A | G | E |

The gaming machine then re-evaluates for further winning symbol outcomes, if any, and repeats the process of evaluation, award, removal and replacement until no winning symbol outcomes appear in the symbol matrix.

For example, a winning symbol outcome ("A-A-A") is formed by the remaining and replacement symbols in the symbol display shown below. In the example, this generates an additional 20-credit award based upon the pay schedule for A-A-A symbol combinations and a further removal cycle (not shown).

| | | | | |
|---|---|---|---|---|
| A | A | A | C | D |
| F | A | F | B | F |
| G | C | A | G | E |

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of playing a game of chance on a gaming machine that includes a credit input mechanism, a player interface, a display, a game controller, and a payout mechanism, the method comprising:

receiving, with the credit input mechanism of the gaming machine, a physical item associated with a monetary value to establish a credit balance;

receiving, one or more player inputs via the player interface, that place, on the game of chance, a wager amount that is funded by the credit balance and that initiate play of the game of chance on the gaming machine;

displaying a first game outcome comprising a plurality of symbols arranged in a plurality of rows and a plurality of columns on the display of the gaming machine;

evaluating, with the game controller, the first game outcome to determine whether the plurality of symbols include a first winning symbol combination;

in response to determining, with the game controller, that the plurality of symbols include the first winning symbol combination, the game controller:

awarding a first award of credits associated the first winning symbol combination;

removing, from the plurality of symbols on the display, symbols forming the first winning symbol combination and all other symbols from each column of the plurality of columns having a symbol forming the first winning symbol combination to obtain a plurality of remaining symbols comprising all symbols in each column of the plurality of columns that do not include a symbol forming the first winning symbol combination; and displaying a second game outcome comprising the plurality of remaining symbols and a plurality of replacement symbols on the display of the gaming machine;

awarding a second award of credits in response to determining that the plurality of remaining symbols and the plurality of replacement symbols include a second winning symbol combination; and dispensing a payout of the credit balance via the payout mechanism of the gaming machine.

2. The method of claim 1, further comprising the game controller selecting a replacement symbol for each symbol removed from the plurality of symbols.

3. The method of claim 1, wherein said displaying the second game outcome comprises the game controller re-arranging the plurality of remaining symbols on the display of the gaming machine.

4. The method of claim 3, wherein said re-arranging the plurality of remaining symbols comprises the game controller moving the plurality of remaining symbols to one or more left-most columns of the plurality of columns with respect to a player's view of the display of the gaming machine.

5. The method of claim 3, wherein said re-arranging the plurality of remaining symbols comprises the game controller moving the plurality of remaining symbols in a defined direction to fill symbol display positions vacated by the removed symbols.

6. The method of claim 1, wherein the first winning symbol combination is one of a plurality of designated winning symbol combinations for the game of chance.

7. The method of claim 1 wherein the plurality of symbols includes at least one substituting symbol used to represent another symbol in the first winning symbol combination.

8. The method of claim 1, further comprising the game controller increasing one or more credit awards for the plurality of remaining symbols in the second game outcome in response to said removing symbols.

9. The method of claim 1, further comprising, in response to the game controller determining that the second game outcome includes the second winning symbol combination, the game controller:

removing, from the second game outcome, symbols forming the second winning symbol combination and at least one further, non-winning symbol to obtain a second plurality of remaining symbols; and displaying a third game outcome comprising the second plurality of remaining symbols and a second plurality of replacement symbols on the display of the gaming machine.

10. The method of claim 9, wherein:

said removing symbols from the first game outcome comprises the game controller removing symbols from the first game outcome in accordance with a first rule that specifies which symbols of the first game outcome are to be removed; and said removing symbols from the second game outcome comprises the game controller removing symbols from the second game outcome in accordance with a second rule that specifies which symbols of the second game outcome are to be removed.

11. The method of claim 1, wherein the game controller conducts a plurality of cycles of removing symbols and selecting replacement symbols.

12. The method of claim 11, wherein a limit is placed on a quantity of cycles in the plurality of cycles.

13. The method of claim 11, wherein the game controller selects different numbers of replacement symbols in at least two of the plurality of cycles.

14. The method of claim 13, wherein each cycle of the plurality of cycles results in one fewer symbol in a game outcome of the respective cycle.

15. The method of claim 13, wherein the plurality of cycles continue until there is no designated winning symbol combination.

16. A gaming machine, comprising:

a display device;

a credit input mechanism configured to receive a physical item associated with a monetary value and establish a credit balance based on said received physical item;

a player interface that enables a player to place a wager on a game of chance of the gaming machine and to initiate play of the game of chance; and a game controller configure to:

select a plurality of symbols for display at respective ones of a plurality of symbol display positions arranged in a plurality of rows and a plurality of columns on the display device;

evaluate a first game outcome to determine whether the plurality of symbols include a first winning symbol combination;

in response to determining that the plurality of symbols include the first winning symbol combination, awarding a first award of credits in respect of the first winning symbol combination, and removing, from the plurality of symbols, symbols forming the first winning symbol combination and all other symbols from each column of the plurality of columns having a symbol forming the first winning symbol combination to obtain a plurality of remaining symbols comprising all symbols in each column of the plurality of columns that do not include a symbol forming the first winning symbol combination;

form a second game outcome comprising the plurality of remaining symbols of the first game outcome;

evaluate the second game outcome to determine whether the second game outcome includes a second winning symbol combination and whether to award a second award of credits associated with the second winning symbol combination; and a payout mechanism configured to dispense a payout of the credit balance from the gaming machine.

17. The gaming machine of claim 16, wherein the game controller is further configured to select a replacement symbol for each symbol removed from the plurality of symbols.

18. The gaming machine of claim 16, wherein the game controller is further configured to re-arrange the plurality of remaining symbols on the display device.

19. The gaming machine of claim 16, wherein the game controller is further arranged to re-arrange the plurality of remaining symbols by moving the plurality of remaining symbols to one or more left-most columns of the plurality of columns with respect to the player's view of the display device.

20. A non-transitory computer readable medium for a gaming machine that includes a credit input mechanism, a player interface, a display device, and a payout mechanism, the non-transitory computer readable medium, comprising a plurality of instructions, that in response to being executed, cause the gaming machine to:

establish a credit balance in response to the credit input mechanism receiving a physical item associated with a monetary value;

place a wager amount that is funded by the credit balance in response to player input received via the player interface;

initiate play of a game of chance in response to player input received via the player interface;

display a first game outcome comprising a plurality of symbols arranged in a plurality of rows and a plurality of columns on the display device;

evaluate the first game outcome to determine whether the plurality of symbols include a first winning symbol combination;

in response to determining that the plurality of symbols include the first winning symbol combination, award a first award of credits associated the first winning symbol combination; remove, from the plurality of symbols on the display device, symbols forming the first winning symbol combination and all other symbols from each column of the plurality of columns having a symbol forming the first winning symbol combination to obtain a plurality of remaining symbols comprising all symbols in each column of the plurality of columns that do not include a symbol forming the first winning symbol combination; and display a second game outcome comprising the plurality of remaining symbols and a plurality of replacement symbols on the display device;

award a second award of credits in response to determining that the plurality of remaining symbols and the plurality of replacement symbols include a second winning combination of symbols; and dispense a payout of the credit balance via the payout mechanism.

21. The non-transitory computer readable medium of claim 20, wherein the plurality of instructions further cause the gaming machine to select a replacement symbol for each symbol removed from the plurality of symbols.

22. The non-transitory computer readable medium of claim 20, wherein the plurality of instructions further cause the gaming machine to rearrange the plurality of remaining symbols on the display device.

23. The non-transitory computer readable medium of claim 20, wherein the plurality of instructions further cause the gaming machine to rearrange the plurality of remaining symbols by moving the plurality of remaining symbols to one or more left-most columns of the plurality of columns with respect to a player's view of the display device.

* * * * *